US006450236B1

(12) United States Patent
Iversen et al.

(10) Patent No.: US 6,450,236 B1
(45) Date of Patent: Sep. 17, 2002

(54) METHOD OF ASCENDING CASTING IN CASTING CAVITIES, AND CASTING MOULD OR MOULD PART FOR USE WHEN CARRYING OUT THE METHOD

(75) Inventors: Peter Iversen, Brønshøj; Uffe Andersen, Skævinge, both of (DK)

(73) Assignee: Georg Fischer Disa A/S, Herlev (DK)

( * ) Notice: Subject to any disclaimer, the term of this patent is extended or adjusted under 35 U.S.C. 154(b) by 0 days.

(21) Appl. No.: 09/402,352

(22) PCT Filed: Apr. 6, 1998

(86) PCT No.: PCT/DK98/00141

§ 371 (c)(1),
(2), (4) Date: Dec. 8, 1999

(87) PCT Pub. No.: WO98/45069

PCT Pub. Date: Oct. 15, 1998

(30) Foreign Application Priority Data

Apr. 7, 1997 (DK) ..... 0387/97

(51) Int. Cl.[7] ..... B22D 39/00

(52) U.S. Cl. ..... 164/133; 164/134; 164/358; 164/362; 164/363; 164/337

(58) Field of Search ..... 164/133, 134, 164/358, 362, 363, 337

(56) References Cited

U.S. PATENT DOCUMENTS 4,832,111 A * 5/1989 Riethmann et al. ..... 164/457
4,913,218 A 4/1990 Seidinger

FOREIGN PATENT DOCUMENTS

JP 59127996 7/1984
JP 4-15390 4/1992

* cited by examiner

*Primary Examiner*—M. Alexandra Elve
*Assistant Examiner*—Len Tran
(74) *Attorney, Agent, or Firm*—Larson & Taylor PLC

(57) ABSTRACT

A method of ascending casting in a casting cavity where filling from the bottom results in a region of reduced pressure formed during the cooling in which solidification can be expected to take place last. The region is post-fed with molten material from a shortest possible feeding duct. By doing this, the consumption of casting metal is reduced, because it is no longer necessary to use a surplus of molten material to keep the bottom ingate open for feeding purposes and the consumption of mold material is also reduced because it is no longer necessary to adapt the mold to accommodate surplus molten material.

13 Claims, 2 Drawing Sheets

METHOD OF ASCENDING CASTING IN CASTING CAVITIES, AND CASTING MOULD OR MOULD PART FOR USE WHEN CARRYING OUT THE METHOD

TECHNICAL FIELD

The present invention relates to a method of casting with pouring from the bottom (ascending casting) with post-feeding and to a casting mould (or mould part), said method and casting mould being of the kind in which regions of reduced pressure formed during the cooling are fed with melt.

BACKGROUND ART

It is commonly known that metals, when cooled from the liquid to the solid state, undergo a reduction in volume, a so-called thermal contraction. In casting moulds, in which a non-uniform heat distribution reigns in the mould cavity after the pouring, and in which for this reason all parts of the casting do not solidify at the same time, this causes the parts of the casting solidifying last to give off liquid metal to compensate for the contraction of the parts of the casting having solidified earlier, possibly leading to faults in the casting, commonly known as "shrinkage holes" appearing in the form of the presence in the surface of the casting, or cavities (macroscopic or microscopic holes) within the casting. In order to avoid these casting faults, the skilled person can take recourse to a series of expedients, of which the most common is the use of feeding reservoirs, i.e. cavities in the mould being filled with metal during the pouring and having such dimensions that the metal in them solidifies later than the parts of the casting solidifying last, being connected to the latter through ducts having a relatively large cross-sectional area, thus being able to post-feed these parts with liquid metal to compensate for the contraction.

Such post-feeding reservoirs are mainly known in two forms, viz. as feeders or risers, i.e. substantially cylindrical cavities leading from the duct connecting them to the casting to the upper surface of the mould, or in the form of internal or closed cavities in the mould, so-called "blind feeders" or "shrinkage knobs" placed in the immediate vicinity of the part of the casting to be post-fed. Compared to the latter type, the former presents the advantage that the highest metallostatic pressure at the feeding location, i.e. the pressure from the superjacent metal column, to a high degree assists the feeding by pressing the feeding metal through the connecting duct into the casting, in contrast to which the pressure in the latter type diminishes during the feeding process. On the other hand, the latter type presents the advantage of normally producing a higher yield of metal in the casting process, i.e. a lesser quantity of metal to be separated from the casting after the casting process for subsequent re-melting (re-circulation), which also reduces the energy used for melting.

When risers or "shrinkage knobs" connected to the mould cavity proper are used, they are conventionally filled with melt having been cooled during the pouring process, which is especially the case with bottom pouring. For this reason, these cavities constituting the post-feeding reservoirs must be made sufficiently large to ensure that—in spite of the cooling—liquid melt is still present in the reservoir for post-feeding when the casting solidifies. The result of this can be that, when using certain alloys or when producing critical castings, a yield of only approximately 50% can be achieved, i.e. that after the casting, the post-feeders and the ingate system weigh the same as the casting to be produced.

The amount of material thus being necessary to melt in addition to what is used for the desired casting itself constitutes an energy loss, increasing the cost of the casting process and at the same time necessitating a higher melting capacity for the foundry equipment.

Some of these disadvantages can be avoided by constructing and using the ingate system as a post-feeding means, to this end comprising post-feeding cavities. In this manner, a post-feeding reservoir is obtained that is heated by the melt on the latter's passage to the mould cavity. Optimally, this post-feeding reservoir must be constructed to have the least possible heat loss, so that the least possible quantity of melt is used for heating the reservoir and maintaining it hot so as to maintain the melt in it in the liquid state. The least possible heat loss is i.a. achieved by constructing the reservoir with the least possible surface area per unit of heat. Further, the heat loss is minimized during the post-feeding process by placing the reservoir close to the mould cavity. The total result of this is that such post-feeding reservoirs, in consideration of the heat loss, are optimally constructed as cavities constituting a large widened part of the ingate system immediately upstream of the inlet to the mould cavity. When using bottom ingates, this does, however, give rise to the disadvantage that the bottom ingate must be shaped and arranged in such a manner that it will not be blocked by solidified melt until the casting itself is solidified to such a degree that post-feeding is no longer necessary.

From DE-36 21 334 it is known to use a movable tube for pouring. The post-feeding is provided by a riser positioned at the top of the casting cavity.

DE-34 44 941 shows another possibility using a movable tube for pouring. The post-feeding is provided from a post-feeding reservoir at the side of the casting cavity, said reservoir being connected to the casting cavity at the bottom via the ingate, which means that the post-feeding is performed through the bottom-filling inlet to the casting cavity, whereby said bottom-filling inlet will have to be constructed in such a manner that it will not be blocked by solidified melt until the casting itself is solidified to such a degree that post-feeding is no longer necessary.

DISCLOSURE OF THE INVENTION

It is, on this background, the object of the present invention to provide a method and casting mould of the kind referred to initially, with which it can be achieved

- that the inlet from the post-feeding reservoir is not blocked by solidified material before the casting itself has solidified to a degree not necessitating additional post-feeding,
- that the surplus material to be removed after the casting process is kept at the lowest level possible,
- that the ingate system, including the post-feeding reservoir, occupies the least possible space in the mould, and
- that the position of the post-feeding can be selected more freely.

This object is achieved with a method of the kind referred to initially, being characterized by the use of an ingate system comprising a downsprue extending downward from an inlet to an outlet communicating with the bottom ingate of the casting cavity and connecting to a feeding reservoir through flow-restricting means, from which feeding reservoir a feeding duct extends to a location in the side of the casting cavity at least approximately at the same level as the level of the region of reduced pressure in the casting cavity in which the solidification can be expected to take place last.

The invention is based upon the fact that, when the post-feeding takes place through a duct debouching close to the place, where the solidification—on the basis of experience and/or calculations—can be expected to take place last, also called the thermal centre of gravity for the casting, the un-solidified melt in the casting and the post-feeding reservoir co-operate to keep the post-feeding inlet duct open, providing the advantage that it is not necessary to use melt for filling a bottom ingate system and keep the latter heated, making it possible to arrange and construct the bottom ingate system primarily with regard to the flow conditions and minimized material consumption and to a lesser degree in consideration of late solidification. Further, the column of melt and the pressure connected to and possibly applied to same may post-feed melt to the mould cavity during the post-feeding process with a minimum of friction.

The present invention also relates to a casting mould or mould part for use when carrying out the method according to the invention. This casting mould or mould part is of the kind set forth above and in detail hereinbelow.

Additional advantageous embodiments of the method and the casting mould or mould part, the effects of which—beyond what is obvious—are explained in the following detailed part of the present description.

BRIEF DESCRIPTION OF THE DRAWINGS

In the following detailed portion of the present description, the invention will be explained in more detail with reference to the drawing, in which FIG. 8 shows an example of pouring in a similar manner as shown in FIG. 5, but according to the invention with separate post-feeding inlet, while

DESCRIPTION OF THE PREFERRED EMBODIMENTS

Figure 1:
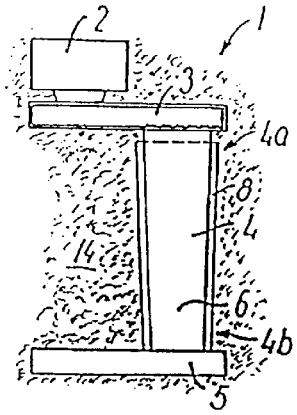
FIG. 1 is a front view of an ingate system for use in a first embodiment.
Figure 3:
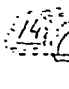
FIG. 3 is a top view showing in cross-section the downsprue shown in FIG. 1 with post-feeding reservoir, gauze screen and downsprue.
Figure 4:
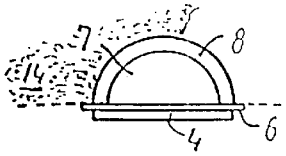
FIG. 4 shows in cross-section at an enlarged scale the downsprue with an insulating layer around the post-feeding reservoir shown in FIG. 3.

FIG. 1 shows an ingate system 1 consisting of a pouring cup 2, a melt runner 3, a downsprue 4 and an inlet 5. In this ingate system, a melt runner 3 is placed downstream of the pouring cup in order to ensure that the melt will not be poured directly down into the downsprue 4, so that the melt will arrive in a calm state at the entrance to the downsprue 4, in the drawing shown as extending vertically. Then, the melt flows from the downsprue top 4*a* to the downsprue bottom 4*b*. In the embodiment shown, the downsprue 4 is shaped like a flat duct which, as will be seen from FIGS. 3 and 4, converges downwardly. The flat-duct shape of the downsprue 4 ensures that the flow in the downsprue 4 can take place substantially laminarly without turbulence.

The shape of the downsprue 4, converging downwardly towards the bottom 4*b*, ensures that low pressure does not arise in the top 4*a* of the downsprue 4, especially during the initial phase of the pouring of the melt, as a correctly converging shape ensures the same static pressure at the top 4*a* as at the bottom 4*b*.

A straight or non-convergent downsprue 4 would cause the "pull" from the melt column to produce a lower pressure at the top 4*a* than at the bottom 4*b*, there being no back pressure from melt in the mould cavity 15 capable of acting in the opposite direction through the ingate system 1. Thus, with this converging shape of the downsprue 4, commonly known to persons skilled within this art, it is possible to ensure a uniform pressure throughout the downsprue 4, when the latter is shaped in consideration of Bemoulli's equations relating to velocity, height and pressure.

One side of the downsprue 4 is in the form of a gauze screen 6 separating a feeding reservoir 7 from the downsprue 4 proper. The gauze screen 6 is permeable to the melt, but offers resistance against such penetration. When, in the initial phase of the pouring, a uniform pressure is being built up in the downsprue 4, this pressure also reigning in the feeding reservoir 7, the gauze screen 6 will, because of its resistance to flow through it, act in the manner of an ordinary duct wall. For this reason, the melt flows in the downsprue 4 proper and does not to any significant extent penetrate into the feeding reservoir 7. The feeding reservoir 7 is, however, heated, at least with radiant heat from the melt flowing through the downsprue 4. As the melt in the mould cavity 15 gradually builds up a back pressure in the downsprue bottom 4*b*, the pressure in the latter will rise, causing melt to penetrate through the gauze screen 6 into the feeding reservoir 7, in which a process of slow filling is initiated. This will continue, the gauze screen 6 still, however, offering a certain resistance against penetration by the melt. When after this, the mould cavity 15 has been filled with melt right up to the top, the liquid flow through the downsprue 4 ceases, and the full pressure from the melt being poured is now applied via the gauze screen 6 to the reservoir 7, the latter then being filled quickly.

Figure 6:
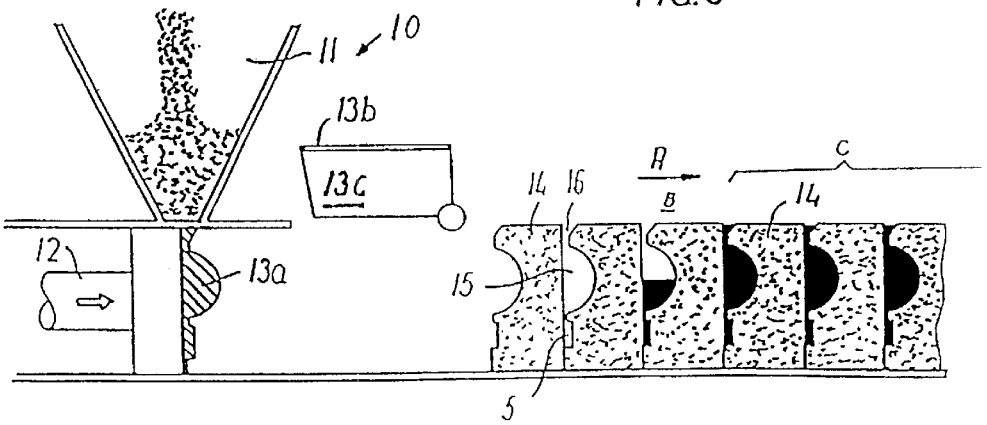
FIG. 6 shows a string-moulding plant, in which the ingate system according to the invention can be used, and which serves to illustrate the process.

After this, the pouring in the pouring station, indicated with B in FIG. 6, ceases, and if the mould is a mould 14 in a string of moulds, it can pass on in the direction of the arrow A to the cooling zone C.

In the cooling zone C, the casting contracts during solidification in the mould cavity 15, resulting in a fall of pressure in the ingate system 1, causing melt to be drawn from the feeding reservoir 7 to fill the cavities produced by the contraction in the mould cavity 15.

Figure 5:
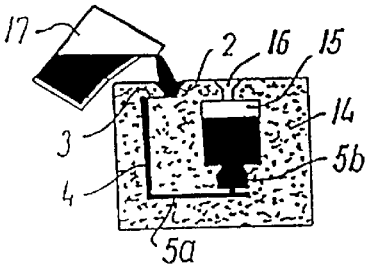
FIG. 5 shows an example of pouring when using the ingate system of FIGS. 1–4 as viewed in section through a mould.

FIG. 5 shows a mould with a bottom inlet comprising an inlet duct 5*a* and an ingate 5*b*, using an ingate system 1 as shown in FIG. 1. When melt is poured from a pouring device 17 into the pouring cup 2, the melt will flow on via the ingate system 1 to the mould cavity 15, the melt ascending through the latter. In FIG. 5, the mould cavity 15 is shown as terminated upwardly by a riser 16, the latter, however, not being absolutely necessary.

As shown in FIG. 6, the mould 14 can be produced in a moulding machine 10, in which mould sand from a supply reservoir 11 is made to run into a moulding space, in which patterns 13*a*, 13*b* on a hydraulic piston 12 and a counter-pressure plate 13*c*, respectively, are pressed against each other so as to form a mould 14, the latter then being pushed out into the string of moulds by the hydraulic piston 12 so as to form a part of the string of moulds. The mould is pushed further to a pouring station B, in which the mould cavity is filled with melt. After this, the mould 14 is moved further in the direction of the arrow A to a cooling zone C, in which the melt solidifies and the casting contracts.

Figure 2:
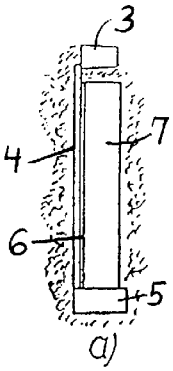
FIGS. 2*a–e* show side views of the ingate system according to FIG. 1 in various degrees of filling.
Figure 2:
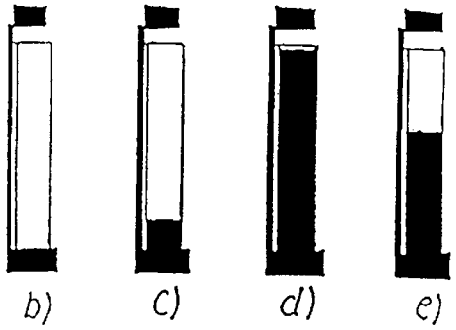

The course of events in the ingate system 1 during this casting process, e.g. in a moulding plant as shown in FIG. 6, is shown in FIG. 2 with FIGS. 2*b*–2*e*. Of these, FIG. 2*b* shows the initial phase of the pouring, during which the ingate system has just been filled up, and FIG. 2*c* shows the situation, in which the back pressure from the melt in the mould causes melt to penetrate into the feeding reservoir 7. When the hydraulic pouring surge occurs as a result of the mould cavity having been completely filled, the feeding reservoir is substantially completely filled as shown in FIG. 2*d*. When, after this, the casting contracts, melt will be drawn from the feeding reservoir 7, as indicated in FIG. 2*e*.

When moulds are being produced in a moulding plant of the kind shown in FIG. 6, the feeding reservoir 7 and the gauze screen 6 can, advantageously be manufactured and inserted in the form of a prefabricated integrated unit, possibly being insulated with an insulating tube 8.

The gauze screen 6 can e.g. be produced from a material consisting of quartz glass in thin fibres, assembled to form a web with square holes bonded with a resin, but the gauze screen may, of course, also be manufactured from other materials that are heat-resistant, e.g. ordinary glass-fibre web.

The permeable wall may be in other forms than a gauze screen; it may e.g. be in the form of a perforated plate, a grate, a sieve or screen etc., e.g. perforations in an insulating tube.

The shape of the duct, in which the feeding reservoir 7 and the gauze screen 6 are situated, may, of course, differ from that shown; it can e.g. be a more or less horizontal canal or duct, in which the gauze screen 6 constitutes the upper side.

Further, the downsprue 4 and the feeding reservoir 7 as such may also have a shape other than that shown, taking into consideration, however, that the flow must be at least substantially laminar, and that it is necessary as explained above to avoid low pressure in the duct system.

Figure 4A:
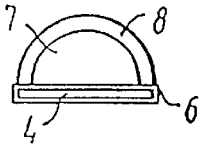
FIG. 4*a* is a cross-section of the downsprue at an enlarged scale, in which the gauze screen surrounds the downsprue.

FIG. 4*a* shows an embodiment, in which the gauze screen 6 surrounds the downsprue 4. With this arrangement, one side of the gauze screen 6 functions as a permeable wall, while its remaining sides function to strengthen the duct. With this arrangement, the duct 4, 5, 5*a* and 5*b* may be in the form of pre-fabricated hollow-profile elements to be inserted as individual units or integrated with the feeding reservoir 7 prior to insertion, or else assembled from two parts each inserted in a respective mould 14.

Figure 4B:
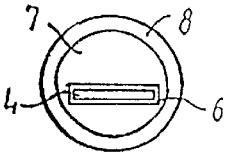
FIG. 4*b* is a cross-section of the downsprue at an enlarged scale, in which the gauze screen forms the downsprue within the post-feeding reservoir.

An especially advantageous construction with pre-fabricated ducts 4 can be achieved, when the latter is inserted in the feeding reservoir 7, and when the latter or parts thereof constitute the duct walls or duct units in the manner indicated in FIG. 4*b*.

This construction makes it i.a. possible to construct the reservoir 7 with a spherical shape and to let the inlet/downsprue 4 extend transversely through the reservoir whilst maintaining a substantially laminar flow, at the same time as the reservoir 7 has a small surface area and hence a low heat loss due to the spherical or cylindrical shape. Further, in this case, all the duct walls are heated by the reservoir 7, and solidification at the walls during the feeding process is avoided.

When the feeding reservoir 7 and the gauze screen 6 are constructed in the form of an integrated unit, this unit can advantageously be prefabricated and inserted during the making of the mould 14.

Further, the feeding reservoir 7 can be provided with means for maintaining the pressure and/or keeping the feeding reservoir 7 under pressure, also when the latter leaves a pouring station, and such pressure-generating means may e.g. be provided in the manner indicated in the International Application No. WO 95/18689.

When used with pouring from the bottom (ascending casting), the requirements to the feeding reservoir 7 are

- the least possible influence on the flow conditions,
- that the feeding reservoir 7 and the duct system leading from it to the mould cavity 15 are so constructed that they will not be blocked by melt solidifying before the feeding process is complete,
- that it is capable of delivering melt to regions in which contraction takes place, and
- that the size of the ingate system including the feeding reservoir 7, later to be removed from the finished cast article, is as small as possible.

Because the castings as such have what could be called a thermal centre of gravity, usually lying centrally in the casting, i.e. above the bottom ingate, and the latter itself lies close to the outside of the mould, i.e. being well cooled, it is necessary to influence these relations when constructing the ingate system when the feeding reservoir is to be situated in it. To begin with, the flow of all the melt into the mould cavity 15 contributes towards heating the bottom to a higher temperature and thus moving the thermal centre of gravity for the casting in a downward direction.

This is, however, insufficient, because the bottom cooling will move the thermal centre of gravity upwardly in the mould cavity, and for this reason, the bottom ingate system must be made of such a size and possibly thermally insulated in such a manner, that the thermal centre of gravity is held closer to the bottom ingate. All this makes the ingate system larger and more complicated.

According to the present invention, these problems are overcome by providing a separate feeding duct from the feeding reservoir 7 to the mould cavity 15 at the latter's thermal centre of gravity.

This feeding duct is so arranged, that it does not establish a connection between the melt in the feeding reservoir and the melt in the mould cavity until the level of melt in the mould cavity has reached the level of the feeding duct or later.

Figure 7:
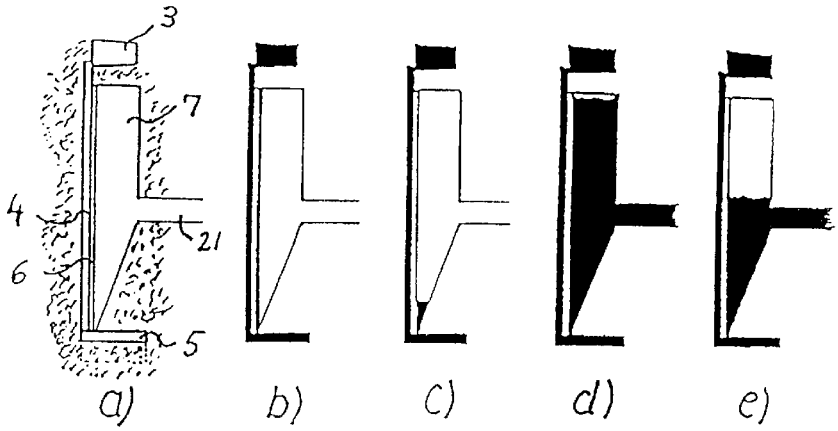
FIGS. 7*a–e* show an ingate system according to the invention, shown in the same manner as in FIG. 2.
Figure 8:
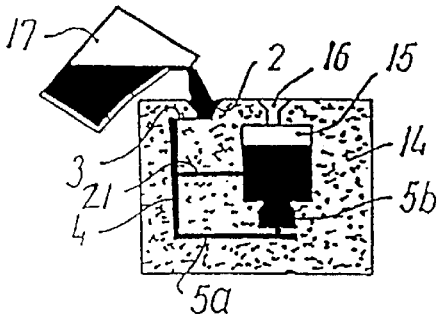

In the embodiment shown in FIGS. 7 and 8 this takes place by a feeding reservoir 7 being gradually filled concurrently with the filling of the mould cavity 15. As shown in FIG. 7, the reservoir 7 is filled gradually while the mould cavity 15 is being filled, and when the level of melt in the feeding reservoir 7 reaches the level of the feeding duct 21, the melt will begin to flow through the latter into the mould cavity 15.

The feeding duct 21 and the feeding reservoir 7 are so constructed and arranged, that the melt does not flow into the mould cavity 15 until it has penetrated from the bottom ingate 5 and upwards in the mould cavity 15 to a level at least as high as the outlet from the feeding duct 21. When the melt has penetrated into the mould cavity 15 via the feeding duct 21, the latter becomes an active component of the ingate system, so that melt is supplied to the mould cavity 15 via the bottom ingate 5 and the feeding duct 21. After this, the supply of melt via the bottom ingate 5 is not strictly necessary, for which reason this ingate is merely arranged to be capable of fulfilling its normal function as a bottom ingate. This means that the bottom ingate 5 is much smaller than if it were also to constitute a feeding duct, possibly without heat insulation.

During this latter part of the normal mould-filling process, the melt having flowed through the feeding duct 21 has heated the latter, and after this, the liquid melt in the heated feeding duct 21 is subjected to a pressure from the melt in the feeding reservoir 7. During the subsequent contraction of the casting in the mould cavity melt for feeding is supplied to the mould cavity 15 via the feeding duct 21.

Thus, with this arrangement it is not necessary to keep the melt in the liquid state in the bottom ingate system proper for feeding purposes. Further, it is possible to deliver the melt during the feeding process close to the thermal centre of gravity for the casting in the mould cavity 15, so that the heating is facilitated, because parts of the casting undergoing contraction will first pull feeding melt from regions close to the thermal centre of gravity at the same time as the latter is fed with melt via the feeding duct 21. This process reduces the frictional resistance against the feeding melt, as the latter does not have to pass previously solidified melt, and the risk of solidified melt interrupting the feeding process before its completion is avoided.

Thus, with this arrangement it is unnecessary to keep the melt in the liquid state in the ingate system below the feeding reservoir 7 and the feeding duct 21, and this reduces the consumption of material in the form of melt and makes it possible to construct the mould in a more compact manner, including the omission of any thermal insulation of the bottom ingate 5. Further, it is not necessary to lower the thermal centre of gravity towards the bottom ingate by means of a large mass of melt and/or insulation in order to keep the bottom ingate free for feeding purposes.

The feeding duct 21 itself can be given any desired shape, and may e.g. be inclined in order to adapt the filling of the feeding reservoir 7 to the filling of the mould cavity 15, or it may be made to constitute a part of the vertical extent of the feeding-melt column.

The feeding duct 21 can advantageously be thermally insulated, and may possibly be pre-fabricated, e.g. together with the feeding reservoir 7 in materials similar to the latter, and be inserted in a manner corresponding to what has been explained above.

Figure 9:
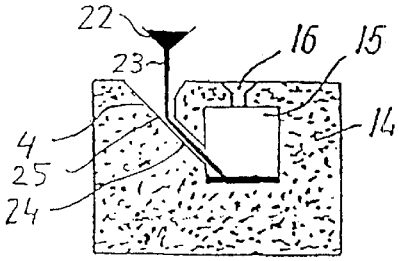
FIGS. 9 and 10 show an example of pouring according to the invention by using a movable tube.
Figure 10:
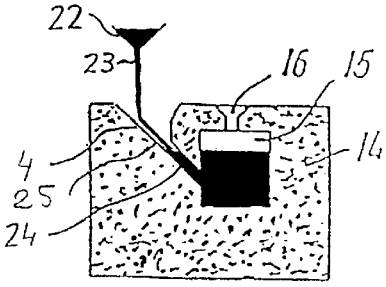

In a second embodiment shown in FIGS. 9 and 10, the bottom ingate is replaced by a pouring tube 23, which at the start of the pouring has been introduced through the pouring inlet 4, and the feeding duct 21 has been replaced by a feeding duct 24, 25 (of which the lower part 24 corresponds to the feeding duct 21 from the feeding reservoir 7 in the previous exemplary embodiment) to the bottom of the mould cavity 15. When pouring has begun, the melt is poured through a funnel 22 and the pouring tube 23 to the bottom of the mould cavity 15, and at the same time as the level of melt in the mould cavity 15 ascends, or before the melt has solidified, the pouring tube 23 is pulled up from the bottom of the mould cavity 15 and away from the latter through the feeding duct 24, 25, during which process the latter's lower part 24, now constituting a feeding reservoir, is filled.

The pouring tube 23 is made from heat-resistant material capable of withstanding the heat encountered during the pouring, and it can advantageously be constructed with a cross-sectional shape ensuring a laminar flow, possibly also converging downwardly as described above, if this is desirable.

The latter arrangement makes it possible to carry out ascending casting under increased pressure without risk of damage to the ingate system or any need of constructing the latter in a special manner with a view to being able to withstand this increased pressure.

Thus, taken as a whole, the invention makes it possible to achieve a saving in material, partly with regard to melt required for pouring, partly with regard to mould-making material for making a mould that can now be made smaller. Further, the quality of the finished casting is improved because the feeding is more effective and certain, when the feeding takes place via a feeding reservoir in the ingate system having been pre-heated by the melt being poured in and debouches close to the thermal centre of gravity for the casting. In addition to this, the quality of the finished casting is improved even more, either by shaping the bottom ingate primarily with a view to good flow conditions, or by omitting the bottom ingate, making it possible to ensure good flow conditions by means of the pouring tube being inserted.

LIST OF PARTS

A arrow
B pouring station
C cooling zone
1 ingate system
2 pouring cup
3 melt runner
4 downsprue/duct/pouring inlet
4*a* downsprue top
4*b* downsprue bottom
5 bottom ingate
5*a* inlet duct
5*b* ingate
6 gauze screen
7 feeding reservoir
8 insulating tube
10 moulding machine
11 supply reservoir
12 hydraulic piston
13*a* pattern
13*b* pattern
13*c* counter-pressure plate
14 mould
15 mould cavity
16 riser
17 pouring device
21 feeding duct
22 funnel
23 pouring tube
24 feeding duct, lower part
25 feeding duct, upper part

What is claimed is:

1. A method of ascending casting of an article from a molten material poured initially into a bottom of a casting cavity where, during cooling of the molten material, a region of reduced pressure forms at which region solidification of the molten material is last expected to take place, said method comprising the steps of:

providing an ingate system having a downsprue, the downsprue extending downward from an inlet to an outlet communicating with a bottom ingate of the casting cavity;

providing a feeding reservoir which connects to the casting cavity through a feeding duct separate from the bottom ingate, the feeding duct extending from the feeding reservoir to a location in a side of the casting cavity at a level of the casting cavity approximately equal to a level of the region of reduced pressure;

separating the feeding reservoir from the downsprue with a flow restricting mechanism, the flow restricting mechanism acting as a barrier to flow and allowing flow of the molten material directly from the downsprue to the feeding reservoir when a sufficient back pressure of the molten material occurs in a bottom of the downsprue as the molten material fills the casting cavity;

pouring molten material into the downsprue of the ingate system such that the feeding reservoir is filled with molten material directly from the downsprue at an ascending level at least no higher than an ascending level of the molten material in the casting cavity; and cooling of the molten material of the casting, said cooling step including feeding of make-up molten material to the cooling casting through the feeding duct from the feeding reservoir and in turn directly from the downsprue.

2. A method of ascending casting as claimed in claim 1:

wherein the ingate system providing step includes providing the downsprue with a length;

wherein the feeding reservoir providing step includes extending the feeding reservoir adjacently along a substantial length of the length of the downsprue; and wherein the separating step includes providing of the flow restricting mechanism as a melt permeable wall along the substantial length of the feeding reservoir between the feeding reservoir and the downsprue.

3. A method of ascending casting as claimed in claim 2, wherein the pouring step includes restricting of the flow of molten material through the flow restricting mechanism into the feeding reservoir until the casting cavity is substantially filled with molten material.

4. A method of ascending casting as claimed in claim 2, wherein the pouring step includes restricting of the flow of molten material through the flow restricting mechanism into the feeding reservoir such that the ascending level in the feeding reservoir approximates the ascending level in the casting cavity.

5. A method of ascending casting as claimed in claim 2, wherein the feeding reservoir providing step includes extending the feeding reservoir to the outlet of the downsprue.

6. A casting mould used for ascending casting of an article from a molten material where, during cooling of the molten material, a region of reduced pressure forms at which region solidification of the molten material is last expected to take place, said casting mould comprising:

a casting cavity having a bottom into which the molten material is initially poured and a predetermined level of the region at which solidification is expected to take place last; and an ingate system which supplies molten material to the casting cavity, said ingate system including (a) a feeding duct having a lower part which debouches at the location in the side of the casting cavity approximately at the predetermined level of the region of reduced pressure, and (b) a pouring tube extending through the feeding duct and having (a) an upper inlet and (b) an outlet at a lowermost end thereof, said pouring tube being movable through said feeding duct in a longitudinal direction of said feeding duct between a pouring position in which said outlet is located close to the bottom of said casting cavity and a feeding position in which said outlet is situated at least at the level of said casting cavity approximately equal to the predetermined level of the region of reduced pressure.

7. A method of ascending casting of an article from a molten material poured initially into a bottom of a casting cavity where, during cooling of the molten material, a region of reduced pressure forms at which region solidification of the molten material is last expected to take place, said method comprising the steps of:

providing an ingate system for the casting cavity which includes a feeding duct having a lower part which debouches at a location in a side of the casting cavity approximately at a level of the region of reduced pressure;

initially pouring molten material into the casting cavity from a pouring tube in a pouring position, the pouring tube extending through the feeding duct and having (a) an upper funnel and (b) an outlet at a lower end thereof located close to the bottom of the casting cavity; and subsequently moving, substantially not later than when filling of the casting cavity is completed, the pouring tube longitudinally in the feeding duct to a feeding position for molten material at which feeding position the outlet of the pouring tube is situated at least at a same level as the location in the side of the casting cavity.

8. A method of ascending casting of an article as claimed in claim 7 wherein said moving step includes the step of moving the outlet so as to substantially follow a rise of a level of the molten material in the casting mould.

9. A casting mould used for ascending casting of an article from a molten material where, during cooling of the molten material, a region of reduced pressure forms at which region solidification of the molten material is last expected to take place, said casting mould comprising:

a casting cavity having a bottom into which the molten material is initially poured through a bottom ingate and a predetermined level of the region at which solidification is expected to take place last;

an ingate system which supplies molten material to the casting cavity, said ingate system including a downsprue extending downward from an inlet to an outlet communicating with said bottom ingate of the casting cavity;

a feeding reservoir for the casting cavity, said feeding reservoir being connected by a feeding duct to a location in a side of said casting cavity at a level approximately equal to the predetermined level of the region of the casting cavity; and a flow-restricting mechanism which separates the feeding reservoir from the downsprue, said flow restricting mechanism acting as a barrier to flow and allowing flow of the molten material directly from the downsprue to the feeding reservoir when a sufficient back pressure of the molten material occurs in a bottom of the downsprue as the molten material fills the casting cavity such that said feeding reservoir is filled with molten material directly from said downsprue to an ascending level at least no higher than an ascending level of the molten material in said casting cavity, and such that during cooling of the molten material of the casting make-up molten material for the cooling casting is drawn through said feeding duct from said feeding reservoir and said downsprue.

10. A casting mould as claimed in claim 9:

wherein said downsprue has a length;

wherein said feeding reservoir extends adjacently along a substantial length of the length of said downsprue; and wherein said flow restricting mechanism forms a melt permeable wall along the substantial length of said feeding reservoir between said feeding reservoir and said downsprue.

11. A casting mould as claimed in claim 10, wherein said flow restricting mechanism restricts flow of the molten material into said feeding reservoir until said casting cavity is substantially filled with molten material.

12. A casting mould as claimed in claim 10, wherein said flow restricting mechanism restricts flow of the molten material into said feeding reservoir such that the ascending level in said feeding reservoir approximates the ascending level in said casting cavity.

13. A casting mould as claimed in claim 10, wherein said feeding reservoir and said flow restricting mechanism extend upwardly from said outlet of said downsprue.

* * * * *